US011953196B1

(12) United States Patent
Rao et al.

(10) Patent No.: US 11,953,196 B1
(45) Date of Patent: Apr. 9, 2024

(54) STEAM GENERATION SYSTEM WITH SUBMERGED SUPERHEATER COIL

(71) Applicant: En-Fab Inc., Houstion, TX (US)

(72) Inventors: Thanneeru D. Rao, Katy, TX (US); Mayur Borad, Houston, TX (US); Abdulla Khalifa Khamis Al Hinai, Seeb (OM); Dane Anderson, Bakersfield, CA (US)

(73) Assignee: En-Fab Inc., Houston, TX (US)

( * ) Notice: Subject to any disclaimer, the term of this patent is extended or adjusted under 35 U.S.C. 154(b) by 0 days.

(21) Appl. No.: 18/455,114

(22) Filed: Aug. 24, 2023

Related U.S. Application Data

(60) Provisional application No. 63/482,905, filed on Feb. 2, 2023.

(51) Int. Cl.
*F22B 33/18* (2006.01)
*E21B 43/24* (2006.01)
*F22G 5/14* (2006.01)

(52) U.S. Cl.
CPC ..... *F22B 33/18* (2013.01); *E21B 43/24* (2013.01); *F22G 5/14* (2013.01)

(58) Field of Classification Search
CPC ..... E21B 43/24; F22B 33/18
See application file for complete search history.

(56) References Cited

U.S. PATENT DOCUMENTS 4,498,542 A * 2/1985 Eisenhawer ..... F22B 1/26 166/57
4,807,701 A * 2/1989 Hall ..... E21B 43/24 166/57
2006/0076428 A1* 4/2006 Knight ..... F22D 1/36 237/19

(Continued)

FOREIGN PATENT DOCUMENTS

CN 101298911 A * 11/2008
EP 2762776 A1 * 8/2014 ..... F22B 35/002

(Continued)

OTHER PUBLICATIONS

Han, CN-101298911-A and translation (Year: 2008).*
Hirano, JP-H11294706-A and translation (Year: 1999).*

*Primary Examiner* — Steven S Anderson, II
(74) *Attorney, Agent, or Firm* — Haynes and Boone, LLP

(57) ABSTRACT

A steam supply system includes a steam generator disposed to produce wet steam for introduction into a steam separator. The steam separator includes a saturated condensate outlet. A superheater receives dry saturated steam from the steam separator and produces superheated steam. An evaporator with an evaporator vessel having a saturated condensate inlet, a soluble solids slurry outlet and a dry steam outlet is in fluid communication with the saturated condensate outlet of the steam separator. Disposed within the evaporator vessel is a superheated steam heat exchanger having a superheated steam outlet and a superheated steam inlet which superheated steam inlet is in fluid communication (Continued)

with the superheater to receive superheated steam. The dry steam outlet of the evaporator is in fluid communication with a steam mixing vessel where the dry steam is mixed with superheated steam from the superheated steam outlet of the heat exchanger.

24 Claims, 3 Drawing Sheets

(56) References Cited

U.S. PATENT DOCUMENTS

| | | | | |
|---|---|---|---|---|
| 2014/0216717 | A1* | 8/2014 | O'Donnell | H10N 10/13 166/90.1 |
| 2014/0262257 | A1* | 9/2014 | Costanzo | F22D 1/02 29/890.051 |
| 2019/0032969 | A1* | 1/2019 | Bartholome | F03G 7/062 |
| 2019/0106346 | A1* | 4/2019 | Kannan | E21B 21/063 |

FOREIGN PATENT DOCUMENTS

| | | | | |
|---|---|---|---|---|
| EP | 3495731 | A1 * | 6/2019 | F22B 29/06 |
| JP | H11294706 | A * | 10/1999 | |

* cited by examiner

STEAM GENERATION SYSTEM WITH SUBMERGED SUPERHEATER COIL

PRIORITY CLAIM

This application claims the benefit of priority to U.S. Provisional Application No. 63/482,905, filed Feb. 2, 2023, the benefit of which is claimed and the disclosure of which is incorporated by reference in its entirety.

FIELD OF THE INVENTION

The present disclosure generally relates to production of steam for use in enhanced oil recovery operations, and more particularly, to the production of process steam having a high quality while minimizing scale formation during the production of the process steam.

BACKGROUND OF THE INVENTION

It is common in the oil and gas industry to inject steam into a wellbore as part of Enhanced Oil Recovery (EOR) operations. The steam for such EOR operations is usually produced by a once-through steam generator (OTSG), which, in its simplest form, is a continuous tube heat exchanger in which preheating and evaporation of feedwater takes place consecutively to produce a steam stream. Once the steam is produced by the OTSG, it may be prepared or enhanced prior to injection. For example, a steam separator may be utilized to separate the steam stream into gaseous water in the form of dry steam from liquid water in the form of condensate (or saturated water). Additionally, the temperature of the dray steam may be increased in a superheater to add heat, yielding superheated steam. As noted, an OTSG produces a steam stream having a gaseous water portion and a liquid water portion, where the term "steam quality" refers to the amount of liquid content in the produced steam such that the lower the water content, the higher the steam quality. In the steam separator, the gaseous water portion of the steam is separated from the liquid water portion of the steam, after which, the gaseous portion may be injected into a wellbore as part of EOR operations. In some cases, the gaseous portion of the steam may first be superheated before injection. Often, prior art OTSGs are limited to producing steam where the gaseous portion of the steam is limited to about 80% quality (weight %) steam or "wet" steam. 80% quality steam is comprised of 80 percent gas and 20 percent liquid water. The percent of water in steam will go down from 20% to only 5% when steam quality goes up from 80% to 95%. Although it is desirable for purposes of EOR applications to generate steam with a quality significantly higher than 80%, such as 95% quality steam or higher, such OTSGs are often limited to 80% because of the need to retain a certain amount of liquid in the steam for to avoid any precipitation of dissolved solids in water, it being understood solids in the steam can damage the OTSG as well as EOR equipment such as superheaters and injection nozzles utilized in the operations. Therefore, because of the need to retain liquid water, only about 80% of the feedwater is allowed to vaporize in the OTSG in order to maintain some of the feedwater as liquid to retain water soluble solids in solution. By maintaining a sufficient quantity of such feedwater as liquid in the OTSG, precipitation of solids, and thus the likelihood of scale formation, particularly in the heating tubes of the OTSG, is minimized. But because of the need to retain approximately 20% liquid to maintain dissolved solids in solution, it is difficult to achieve steam of a quality significantly higher than 80%, unless the incoming feedwater has zero or negligible amount of total dissolved solids thus obviating the need to retain a portion, i.e., 20%, of the feedwater as liquid. Feedwater with negligible amounts of total dissolved solids is not typically feasible because water treatment costs to remove solids in order to achieve a higher quality steam are expensive, especially to produce sufficiently pure feedwater that would be suitable to generate dry steam in radiant section of a conventional OTSG.

With that said, higher quality (95% nominal quality) steam, such as dry steam or superheated steam, has some definite advantages over 80% quality wet steam for purposes of EOR operations. Injecting higher quality steam in EOR operations can result in a more efficient process, and yield higher oil production volumes due to the higher heat injected into a wellbore for the same amount of steam. 95% quality steam has higher heat content compared to 80% quality steam on a unit mass basis. This is because of 18% more latent heat of vaporization present in 95% quality steam compared to 80% quality steam at 1,500 psig. Specifically, 95% quality steam has 83.4 Btu/lb of higher heat content than 80% quality steam. This translates into an increase of 8% higher heat content for 95% quality steam.

Moreover, the amount of feedwater that is required for the same heat output will decrease with dry or superheated steam. Because there is no liquid content associated with superheated steam, there will be a corresponding reduction in pumping and water treatment costs.

Additionally, when there is flow split in the piping system utilized to deliver the EOR steam to a formation, it is difficult to maintain the same steam quality through each branch of the piping system. Some piping branches will have higher quality steam (less water) and some will have lower quality (more water) steam. This results in an uneven flow distribution and significant variation in heat input among different formation injection points of the piping system. Dry or superheated steam will minimize this inherent problem associated with the distribution of wet steam in a split piping system. This distribution improvement is due to the lack of water in the steam.

Finally, regardless of the OTSG, there is a need to manage the liquid portion of the steam stream which exits the steam separator as saturated water. This saturated water, once it has been utilized to remove solids, must be disposed of. Because water disposal costs are often high and can decrease the cost effectiveness of EOR operations, one solution for disposal of this saturated water is to reintroduce it back into the steam stream that is to be injected into a wellbore. As noted above, steam from a steam separator is typically introduced into a superheater to produce superheated steam for injection into a wellbore. The effect of mixing at least a portion of the saturated water back into the superheated steam stream results in converting the superheated steam back into 95% quality steam. In the prior art, since it is in a liquid stated, the saturated water is often introduced directly into the flow path of the superheated steam stream in a desuperheater having nozzles through which the saturated water is sprayed. Typically, when the saturated water droplets come into contact with superheated steam (which is at a much higher temperature), the saturated water droplets evaporate instantaneously upon contact with superheated steam, resulting in precipitation of solids from saturated water. These solids often plug up the nozzles and cause scale formation in surrounding areas of desuperheater and piping.

BRIEF DESCRIPTION OF THE DRAWINGS

For a more complete understanding of the present disclosure and its features and advantages, reference is now made to the following description, taken in conjunction with the accompanying drawings, in which.

DETAILED DESCRIPTION OF THE DISCLOSURE

Disclosed herein is a steam supply system for providing process steam of a desired quality for injection in a wellbore during enhanced oil recovery operations, wherein saturated condensate from a steam separator is evaporated using superheated steam to produce dry steam, which is then mixed with the superheated steam to produce process steam that is dry or superheated. More specifically, wet steam from a OTSG is separated in a steam separator into dry saturated steam and saturated condensate having totally dissolved solids (TDS) therein. The dry saturated steam is heated in a superheater to produce superheated steam. In order to recycle a portion of the saturated condensate while also removing the TDS, the saturated condensate collected in the steam separator and is sent to an evaporator. The evaporator includes a dry steam outlet in an upper portion of a fluid vessel and a slurry outlet in a lower portion of the fluid vessel. Saturated condensate is introduced into the vessel and forms a saturated condensate bath in the lower portion of the vessel. Submerged in the saturated condensate bath is one or more superheated steam heat exchange conduits that are in fluid communication with the superheater. The superheated steam heat exchange conduits are disposed to deliver heat from the superheated steam to the saturated condensate, resulting in evaporation of a portion of the saturated condensate. Evaporation of the saturated condensate produces dry steam that can then be mixed with superheated steam in a mixing vessel. In one or more embodiments, the mixing vessel is in fluid communication with the evaporator with respect to both the dry steam produced therein and the superheated steam used therein such that the superheated steam utilized in the evaporator for evaporation can then be mixed with the dry steam in the mixing vessel to produce the process steam.

Figure 1:
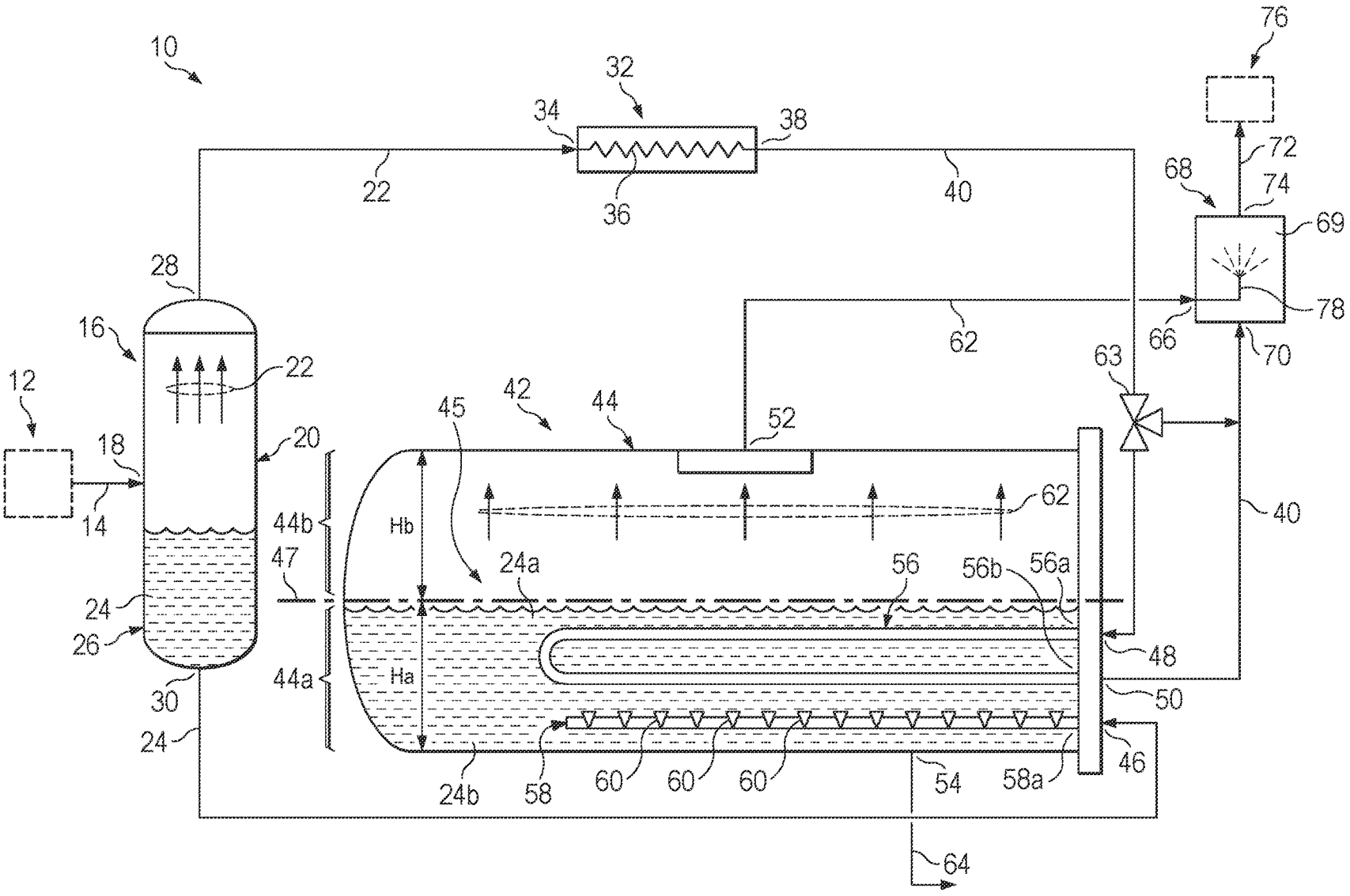
FIG. 1 is a schematic diagram of a steam generation system.

With reference to FIG. 1, a steam supply system 10 is shown and includes a steam source 12, a steam separator 16, a steam superheater 32, an evaporator 42 and a steam mixing vessel 68. Steam source 12 generates wet steam 14. Steam source 12 is in fluid communication with steam separator 16 having a separation vessel 20. Wet steam 14 is delivered to the steam separator 16 via a steam inlet 18 disposed in separation vessel 20. While steam source 12 is not limited to a particular system, in one or more embodiments, steam source 12 may be an OTSG such is described below with reference to FIG. 2. In other embodiments, steam source may be other types of steam generators, including but not limited to heat recovery steam generators (HRSGs), electric steam generators and the like. In any event, within separation vessel 20 of steam separator 16, dry saturated steam 22 separates from saturated condensate 24, with the saturated condensate 24 collecting in a lower portion 26 of separation vessel 20, and the dry saturated steam 22 passing through a steam outlet 28 within separation vessel 20. It will be appreciated that saturated condensate 24 includes retained water soluble solids in solution, and the saturated condensate 24 is utilized to remove these solids from the steam supply system 10, and in particular, the steam separator 16. As such, the saturated condensate 24 is removed from steam separator 16 through a condensate outlet 30 disposed within separation vessel 20.

Steam separator 16 is in fluid communication with superheater 32, allowing the dry saturated steam 22 exiting steam separator 16 to flow to superheater 32. Specifically, the steam outlet 28 of separation vessel 20 is in fluid communication with a steam inlet 34 of superheater 32. It will be appreciated that superheater 32 is not limited to any particular type of superheater, and may include radiant, convection, and separately fired superheaters. For purposes of the disclosure, while generally described in FIG. 1, superheater 32 is shown as a convection superheater in FIG. 2 as described below. Notwithstanding the foregoing, in one or more embodiments, superheater 32 may include a heat exchanger interface 36 to increase the temperature of dry saturated steam 22 introduced to superheater 32. For example, heat exchanger interface 36 may be superheater tubes exposed to convention and/or radiant heat transfer. In any event, dry saturated steam 22 entering superheater 32 is heated and exits superheater 32 via steam outlet 38 as superheated steam 40.

Separation vessel 20 is in fluid communication with evaporator 42, and in particular, condensate outlet 30 disposed within separation vessel 20 is in fluid communication with a saturated condensate inlet 46 of evaporator 42 to allow the saturated condensate 24 from steam separator 16 to flow to evaporator 42. Evaporator 42 includes an elongated, horizontal vessel 44 having a saturated condensate inlet 46, a superheated steam inlet 48, a superheated steam outlet 50, a dry steam outlet 52 and a slurry outlet 54. Saturated condensate 24 is introduced into vessel 44 and collects as a saturated condensate bath **24*b* in a lower portion 44*a* of vessel 44 so that the surface 24*a* of saturated condensate bath 24*b* is spaced apart from dry steam outlet 52 disposed within an upper portion 44*b* of vessel 44. In one or more embodiments, upper portion 44*b* is characterized by a height $H_b$ and lower portion 44*a* is characterized by a height $H_a$ relative to elongated horizontal axis 47 extending along the surface 24*a* of saturated condensate bath 24*b*, where height $H_a$ and height $H_b$ are substantially equivalent so that horizontal axis 47 is positioned along the centerline of the vessel 44. The reason for keeping the condensate water surface at the centerline of vessel 44** is to obtain the maximum relieving surface area for the vessel of a given diameter.

Disposed within the interior 45 of vessel 44 are one or more superheated steam heat exchange conduits 56, each with a first end **56*a* in fluid communication with the superheated steam inlet 48 and a second end 56*b* in fluid communication with the superheated steam outlet 50. Superheated steam heat exchange conduits 56 are not limited to any particular arrangement or configuration. In some embodiments, steam heat exchange conduit 56 may be elongated and extend along a substantial portion of the length of vessel 44 in order to maximize surface contact with saturated condensate 24 disposed within vessel 44. In some embodiments, steam heat exchange conduit 56 may be formed of two or more elongated, substantially linear pipes interconnected with one another. In some embodiments, steam heat exchange conduit 56 may have a plurality of coil loops formed along steam heat exchange conduit 56. In some embodiments, steam heat exchange conduit 56 may a tube bank. In some embodiments, steam heat exchange conduit 56 may be other heat exchangers consistent with use as described herein. To maximize heat transfer and dry steam production, superheated steam heat exchange conduits 56 are submerged below the surface 24***a* of saturated condensate 24.

Saturated condensate 24 is introduced into vessel 44 via saturated condensate inlet 46. In some embodiments, evaporator 42 may include a condensate pipe manifold 58 extending within vessel 44 with a condensate manifold inlet 58*a* in fluid communication with saturated condensate inlet 46 of vessel 44. In one or more embodiments, condensate pipe manifold 58 is elongated and extends along a portion of the length of vessel 44. Condensate pipe manifold 58 may be horizontal and positioned in the lower portion 44*a* of vessel 44 below steam heat exchange conduits 56. Condensate pipe manifold 58 may include one or more nozzles 60 disposed along condensate pipe manifold 58 for injecting saturated condensate 24 into the interior 45 of vessel 44. In some embodiments, condensate pipe manifold 58 may include a plurality of nozzles 60 in fluid communication with the interior 45 of vessel 44. It will be appreciated that in some embodiments, to further maximize heat transfer and dry steam production, vessel 44 is elongated and horizontal to increase the area of surface 24*a* of saturated condensate 24 within vessel 44, and superheated steam heat exchange conduits 56 are likewise elongated and horizontal.

Superheated steam 40 passing through superheated steam heat exchange conduits 56 causes the saturated condensate 24 within vessel 44 to evaporate, yielding dry steam 62 which collects in the upper portion 44*b* of vessel 44 before exiting vessel 44 through dry steam outlet 52. In one or more embodiments, the dry steam 62 produced in evaporator 42 can be mixed in a steam mixing vessel 68 with superheated steam 40, while in other embodiments, the dry steam 62 produced in evaporator 42 can be used for other purposes and need not be directed to steam mixing vessel 68 (and thereby eliminating the need for steam mixing vessel 68 in some embodiments). In one or more embodiments, superheated steam heat exchange conduits 56 may be coated with a high temperature superhydrophobic coating to reduce surface wettability thereby reducing potential for scale buildup on superheated steam heat exchange conduits 56.

One benefit to the above-described system 10 is that the submerged superheated steam heat exchange conduits 56 can be quickly removed from vessel 44 and replaced without the need for interrupting operation of the OTSG 12. To facilitate such a replacement of superheated steam heat exchange conduits 56, three-way valve 63 may be utilized to divert superheated steam 40 from evaporator 42. At other times, three-way valve 63 may be utilized to direct a first portion of superheated steam 40 to steam mixing vessel 68 and to direct a second portion of superheated steam 40 to evaporator 42 in order to supply the heat need for evaporation of saturated condensate 24 therein. Of course, three-way valve 63 also may be utilized to direct all of the superheated steam 40 to evaporator 42.

Slurry outlet 54 is formed in the lower portion 44*a* to remove as soluble solids slurry 64 those totally dissolved solids (TDS) that were in the saturated condensate 24 from separator 16. The TDS in soluble solids slurry 64 is more concentrated than in saturated condensate 24 leaving separator 16. In other words, saturated condensate 24 has a first concentration of soluble solids and soluble solids slurry 64 has a second concentration of soluble solids that is greater than the first concentration.

It should be noted that while evaporator 42 is most effective where vessel 44 is elongated and substantially horizontal, and likewise, superheated steam heat exchange conduit(s) 56 are elongated and substantially horizontal, other orientations are possible. For example, vessel 44 may be vertical and superheated steam heat exchange conduit(s) 56 may be vertical. Likewise, vessel 44 and superheated steam heat exchange conduit(s) 56 may have other shapes and/or orientations, provided that saturated condensate 24 can be evaporated utilizing superheated steam 40 to produced dry steam 62 that can be mixed with superheated steam 40 to produce process steam 72. In one or more preferred embodiments, evaporation heat from superheated steam 40 is delivered via superheated steam heat exchange conduit(s) 56 that are submerged in the saturated condensate 24.

The dry steam 62 from evaporator 42 may then mixed with superheated steam 40 in a steam mixing vessel 68 to produce process steam 72 which can be superheated or dry saturated steam. In other embodiments, the wet steam 14 has a % quality of approximately 80% and the process steam 72 has a % quality of approximately 95%. In one or more embodiments, at least a portion of the superheated steam 40 utilized in evaporator 42 may be utilized in steam mixing vessel 68. In this regard, superheated steam 40 exiting the superheated steam heat exchange conduit(s) 56 is directed to steam mixing vessel 68. In one or more embodiments, the dry steam outlet 52 of evaporator 42 is in fluid communication with a dry steam inlet 66 of steam mixing vessel 68, and likewise, the superheated steam outlet 50 of evaporator 42 is in fluid communication with a superheated steam inlet 70 of steam mixing vessel 68, thereby allowing the superheated steam from superheater 32 to be mixed with the dry steam of evaporator 42 before the process steam 72 exits steam mixing vessel 68 via an outlet 74 for downstream use. In one or more embodiments, once the superheated steam 40 is mixed with the dry steam 62 of evaporator 42 to create process steam 72, the process steam 72 exits steam mixing vessel 68 via an outlet 74 for use with downstream equipment 76. In one or more embodiments, downstream equipment may be a wellbore tool 76 utilized to inject the steam into an oil and gas wellbore (not shown). However, in other embodiments, downstream equipment 76 may be other devices, such as a steam turbine for electricity generation, a steam engine, a steam reformer for producing syngas, cracking units, distillation units. For purposes of the disclosure, the steam supply system 10 will be described in terms of steam utilized in EOR operations.

More specifically, mixing of dry steam 62 with superheated steam 40 within steam mixing vessel 68 occurs within a chamber 69 by spraying the dry steam 62 into the superheated steam 40 stream via one or more nozzles 78 arranged within steam mixing vessel 68. Nozzles 78 are not limited to a particular device, but may be any device with an opening or aperture to allow dry steam 62 to be introduced into chamber 69 for mixing with superheated stream 40. Because dry steam 62 has been produced by evaporation of saturated condensate 24 in evaporator 42, dry steam 62 is primarily devoid of solids when dry steam 62 is introduce into chamber 69. As used herein, steam mixing vessel 68, which can also be referred to as a desuperheater, may be a chamber, enclosure, valve or other device that allows the dry steam 62 to be introduced into a superheated steam 40 stream. It will be appreciated that while outlet 74 is in fluid communication with downstream equipment 76, various additional steam handling devices may be disposed therebetween to assist in handling of the process steam 72, including but not limited to steam pumps (not shown). Moreover, where downstream equipment 76 is a wellbore tool, the wellbore tool may be a drill string, a production string or any other downhole tool that can be positioned within a wellbore (not shown) to release process steam 72 therein. As noted above, in some embodiments, the process steam 72 need not be injected into a wellbore at all, but may be used for other purposes consistent with the need for dry steam resulting from steam supply system 10.

Figure 2:
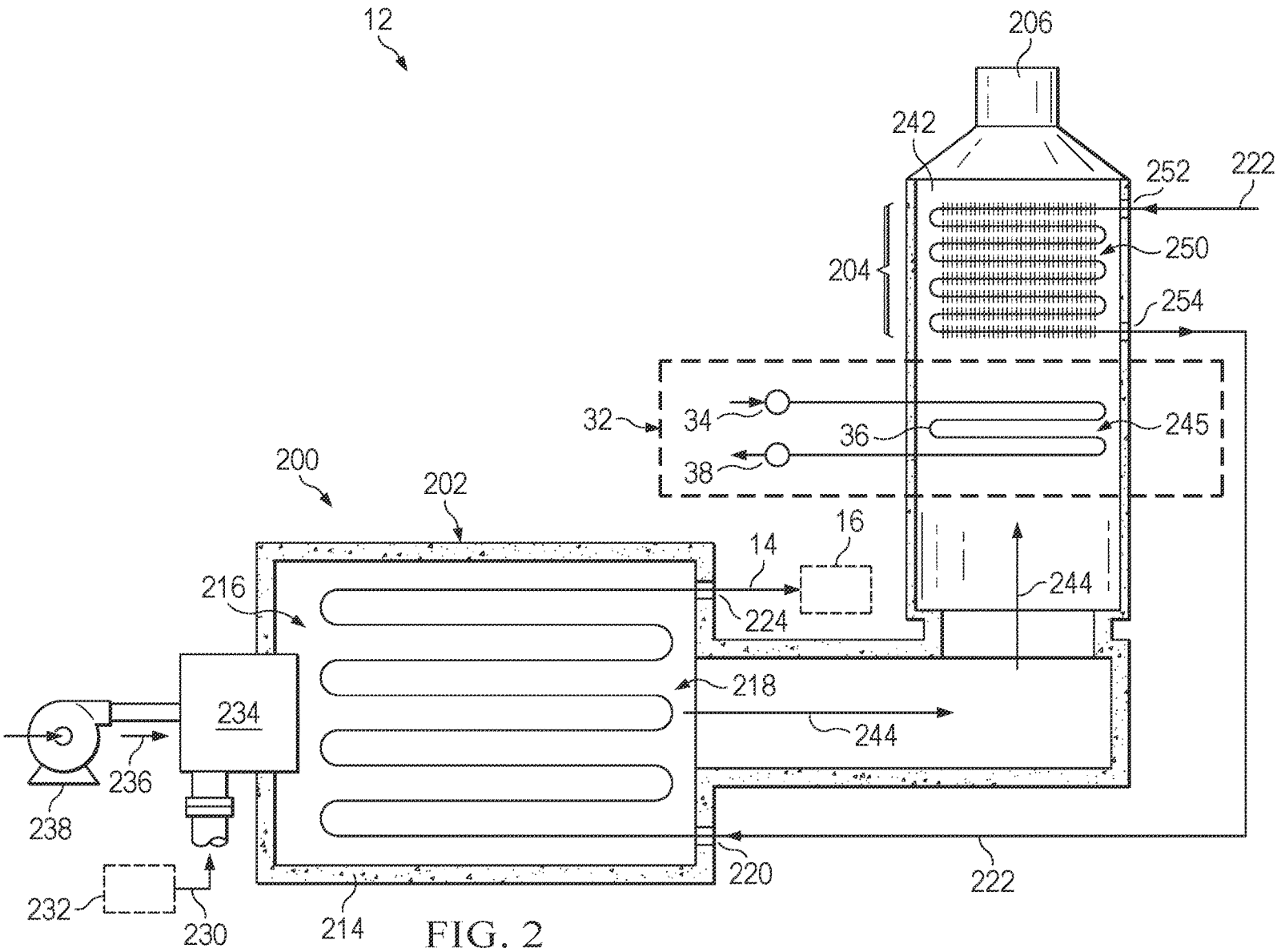
FIG. 2 is a schematic diagram of an OTSG utilized as a component of the steam generation system.

Turning to FIG. 2, one embodiment of a steam source 12 is shown. In this embodiment, steam source 12 is depicted as a OTSG 200 having radiant section 202, a convection section 204 and a flue gas stack 206. Radiant section 202 is formed of an enclosure 214 having an interior 216 with a feedwater tube bank 218 disposed therein. Tube bank 218 includes a feedwater inlet 220 to provides feedwater 222 to tube bank 218, and tube bank 218 includes a wet steam outlet 224 that is in fluid communication with steam inlet 18 of steam separator 16 (see FIG. 1) to deliver wet steam 14 to steam separator 16. A fuel source 232, provides fuel 230, such as natural gas, to a burner 234 where air 236 is introduced into burner 234 by a blower 238. Burner 234 is disposed to deliver heat to the interior 216 of radiant section 202, converting the feedwater 222 within tube bank 218 into wet steam 14.

In the illustrated embodiment, superheater 32 (see also FIG. 1), is integrally formed as part of the convection section 204 of OTSG 200. Specifically, convection section 204 includes an interior 242 through which flue gas 244 from radiant section 202 is directed before passing from OTSG 200 through a flue gas stack 206. The heat exchange interface 36 of superheater 32 is disposed within convection section 204 to heat dry saturated steam 22 entering superheater 32 via steam inlet 34. Specifically, in one or more embodiments, heat exchange interface 36 is a tube bank 245 disposed within the interior 242 of convection section 204 so that flue gas 244 passing therethrough can heat the dry saturated steam 22 within tube bank 245 before it passes through steam outlet 38 as superheated steam 40.

Although not necessary, in one or more embodiments, feedwater 222 may be preheated in convection section 204 prior to introduction into feedwater tube bank 218. In the illustrated embodiment, a preheater heat exchanger 250 may be disposed in the interior 242 of convection section 204. Preheater heat exchanger 250 includes a feedwater inlet 252 and a feedwater outlet 254, where feedwater outlet 254 is in fluid communication with feedwater inlet 220 of feedwater tube bank 218. Preheater heat exchanger 250 may be a tube bank as shown. In any event, in addition to heating dry saturated steam 22 passing through superheater 32, flue gas 244 flowing through convection section 204 to flue gas stack 206 also preheats feedwater 222 in tube bank 250 prior to introduction of the feedwater 222 into the radiant section 202 of OTSG 200.

Figure 3:
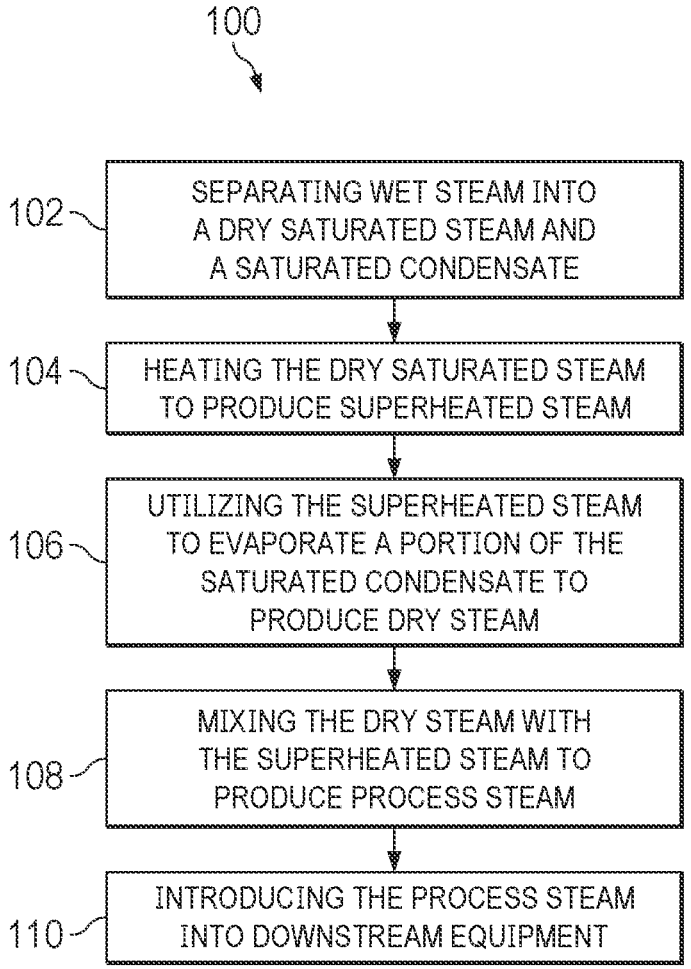
FIG. 3 is a flow chart of a method for supplying process steam.

FIG. 3 illustrates a method 100 for steam supplying steam. In a step 102 of method 100, wet steam 14 is separated into a dry saturated steam 22 and a saturated condensate 24. The wet steam 14 may be produced from a steam source 12, such as the OTSG 200 illustrated in FIG. 2. In this regard, steam source 12 may convert feedwater 222 into wet steam 14 utilizing radiant heat. Moreover, in some embodiments, the feedwater 222 may be preheated utilizing flue gas 244 from OTSG 200. In any event, the wet steam 14 generated by steam source 12 may be approximately 80% quality, but generally no more than 88% quality. Moreover, the wet steam 14 may include solids dissolved in the wet steam 14. Thus, in step 102, the dissolved solids remain in solution in the saturated condensate 24 so that the dissolved solids can be removed for disposal. Step 102 may occur in a steam separator 16. In some embodiments, the temperature of the wet steam 14 may be approximately 597° F. at 1500 psig, while the temperature of the dry saturated steam 22 may be approximately 597° F. at 1500 psig. Finally, the temperature of the saturated condensate 24 may be approximately 597° F. at 1500 psig.

In step 104, the dry saturated steam 22 is heated to produce superheated steam 40. In this step 104, the dry saturated steam 22 may be passed through a superheater 32 to produce the superheated steam 40. In one or more embodiments, the heat is transferred by convection and radiation to the dry saturated steam 22 via flue gas resulting from the production of the wet steam 14. In some embodiments, the temperature of the superheated steam 40 leaving superheater 32 may be approximately 800° F. at 1500 psig.

In step 106, a portion of the saturated condensate 24 is evaporated utilizing superheated steam 40 to produce dry steam 62. In one or more embodiments, superheated steam heat exchange conduits 56 are utilized to transfer heat to the saturated condensate 24. In this regard, the superheated steam heat exchange conduits 56 through which superheated steam 40 passes may be submerged in a saturated condensate bath **24*b* to facilitate evaporation. The saturated condensate 24 from steam separator 16 may be introduced into an elongated vessel 44 and collected in the lower portion 44*a* of vessel 44 where the superheated steam heat exchange conduits 56 are positioned. It will be appreciated that this step also concentrates any dissolved solids in the liquid remaining after evaporation. This concentrated soluble solids slurry can then be disposed of, but with much less wastewater than prior art steam production systems. In one or more embodiments, during operation of system 10, a small amount of solids soluble slurry 64 is continuously withdrawn from the lower portion 44*a* of vessel 44 as saturated condensate 24 is introduced into vessel 44. For example, in some embodiments, from the original 20% of water collected in the steam separator 16, only about 2-5% of that need be discarded, while the remaining amount can be recycled into dry steam. In some embodiments, the temperature of the dry steam 62 may be approximately 595° F. at 1500 psig. In some embodiments, the temperature of the superheated steam 40 leaving evaporator 42** may be approximately 634° F. at 1500 psig.

In step 108, the dry steam 62 is mixed with the superheated steam 40 to produce process steam 72. In one or more embodiments, mixing occurs by introducing the dry steam 62 into a stream of superheated steam 40. While in some embodiments, the dry steam 62 may be sprayed in the direction of flow of the superheated steam 40, because solids have been removed from the dry steam 62, the direction of the sprayed dry steam 62 relative to the direction of flow of the stream of superheated steam 40 is less significant, particularly in regards to concerns about the formation of scale resulting from the mixing. In any event, in one or more embodiments, at least a portion of the superheated steam 40 mixed with the dry steam 62 to produced process steam 72 is also utilized, prior to the step of mixing, to produce the dry steam 62. Thus, in some embodiments, at least a portion of the superheated steam 40 used to produce process steam 72 is taken from an evaporator 42. In some embodiments, all of the superheated steam 40 utilized in the step of mixing is first used for evaporation of saturated condensate 24, while in other embodiments, at portion of the superheated steam 40 utilized in the step of mixing may also be taken directly from a superheater 32. In some embodiments, the temperature of the process steam 72 may be approximately 624° F. at 1500 psig.

In step 110, the process steam 72 is then introduced into downstream equipment for further use. Thus, in one or more embodiments, step 110 may include injecting the process stream into a wellbore for EOR operations. In one or more embodiments, step 110 may include passing the process steam 72 through a steam turbine for electricity generation. In one or more embodiments, step 110 may include utilizing the process steam 72 to drive a steam engine. In one or more embodiments, step 110 may include introducing the process steam 72 into a steam reformer to produce syngas. In one or more embodiments, step 110 may include utilizing the process steam 72 for the production of chemicals in cracking units or distillation units.

Although various embodiments have been shown and described, the disclosure is not limited to such embodiments and will be understood to include all modifications and variations as would be apparent to one skilled in the art. Therefore, it should be understood that the disclosure is not intended to be limited to the particular forms disclosed; rather, the intention is to cover all modifications, equivalents, and alternatives falling within the spirit and scope of the disclosure as defined by the appended claims.

What is claimed is:

1. A steam supply system comprising:

a steam source;

a steam separator in fluid communication with the steam source;

a superheater in fluid communication with the steam separator;

an evaporator in fluid communication with the steam separator and the superheater; and a mixing vessel in fluid communication with the evaporator, the mixing vessel having a process steam outlet;

wherein the evaporator comprises a dry steam outlet and a superheated steam outlet, and wherein the mixing vessel comprises a dry steam inlet in fluid communication with the dry steam outlet of the evaporator and a superheated steam inlet in fluid communication with the superheated steam outlet of the evaporator.

2. The system of claim 1, wherein the evaporator comprises an elongated, horizontal vessel with a saturated condensate inlet, a slurry outlet, and the dry steam outlet disposed in the evaporator vessel; an elongated superheated steam heat exchange conduit extending along a portion of the length of the evaporator vessel, the superheated steam heat exchange conduit having a superheated steam inlet, the superheated steam heat exchange conduit in fluid communication with the superheated steam outlet, and with the superheated steam inlet of the superheated steam heat exchange conduit in fluid communication with the superheated steam outlet of the superheater; and an elongated, substantially horizontal condensate pipe manifold extending within a lower portion of the evaporator vessel, the condensate pipe manifold having a manifold inlet in fluid communication with saturated condensate inlet of the evaporator vessel and a plurality of nozzles disposed along at least a portion of the length of the condensate pipe manifold.

3. The system of claim 1, wherein the evaporator comprises an evaporator vessel with at least one superheated steam heat exchange conduit disposed in a lower portion of the evaporator vessel with the dry steam outlet disposed in an upper portion of the evaporator vessel.

4. The system of claim 3, wherein the superheated steam heat exchange conduit is a pipe loop.

5. The system of claim 3, wherein the evaporator vessel is horizontally elongated, and the superheated steam heat exchange conduit is elongated and extends along at least one-half of the length of the evaporator vessel.

6. The system of claim 3, wherein the superheated steam heat exchange conduit comprises two or more elongated, substantially linear pipes fluidically interconnected with one another.

7. The system of claim 3, further comprising a saturated condensate inlet in fluid communication with the lower portion of the evaporation vessel.

8. The system of claim 7, further comprising a slurry outlet disposed in the lower portion of the evaporator vessel.

9. The system of claim 7, further comprising a condensate pipe manifold extending within the evaporator vessel, the condensate pipe manifold having a manifold inlet in fluid communication with saturated condensate inlet of the evaporator vessel.

10. The system of claim 9, wherein the condensate pipe manifold includes a plurality of nozzles disposed along the condensate pipe manifold.

11. The system of claim 1, wherein the steam source comprises a once-through steam generator.

12. The system of claim 3, wherein the steam heat exchange conduit is coated with a high temperature superhydrophobic coating.

13. The system of claim 1, further comprising downstream equipment in fluid communication with the process steam outlet of the mixing vessel.

14. The s system of claim 13, wherein the downstream equipment is a wellbore tool.

15. A steam supply system comprising:

a steam source;

a steam separator in fluid communication with the steam source, the steam separator having a condensate outlet and a steam outlet;

a superheater in fluid communication with the steam outlet of the steam separator;

an evaporator separate from the superheater, the evaporator in fluid communication with the condensate outlet of the steam separator, and the evaporator in superheated steam fluid communication with the superheater downstream of the super heater; and a mixing vessel having a process steam outlet, the mixing vessel in fluid communication with the evaporator.

16. A steam supply system comprising:

a once-through steam generator (OTSG) having a wet steam outlet;

a steam separator comprising a separation vessel with a wet steam inlet, a dry saturated steam outlet and a saturated condensate outlet, wherein the wet steam outlet of the OTSG is in fluid communication with the wet steam inlet of the steam separator;

a superheater with a dry saturated steam inlet and a superheated steam outlet, wherein the dry saturated steam inlet of the superheater is in fluid communication with the dry saturated steam outlet of the steam separator; and an evaporator comprising an elongated vessel having an upper vessel portion and a lower vessel portion, with a saturated condensate inlet, a slurry outlet, and a dry steam outlet disposed in the upper vessel portion of the evaporator vessel; an elongated superheated steam heat exchange conduit extending along at least a portion of the length of the vessel, the superheated steam heat exchange conduit having a superheated steam outlet and a superheated steam inlet with the superheated steam inlet of the superheated steam heat exchange conduit in fluid communication with the superheated steam outlet of the superheater; and an elongated, condensate pipe manifold extending within the lower vessel portion of the evaporator, the condensate pipe manifold having a manifold inlet in fluid communication with saturated condensate inlet of the evaporator vessel and a plurality of nozzles disposed along the condensate pipe manifold.

17. The system of claim 16, further comprising a steam mixing vessel having a dry steam inlet in fluid communication with the dry steam outlet of the evaporator; a superheated steam inlet in fluid communication with the outlet of the superheater coil; and a process steam outlet.

18. The system of claim 16, wherein the elongated superheated steam heat exchange conduit is disposed in the lower portion of the elongated vessel and the condensate pipe manifold is disposed in the elongated vessel below the superheated steam heat exchange conduit.

19. The system of claim 16, where the superheated steam heat exchange conduit comprises a plurality of tubes.

20. The system of claim 19, wherein the once-through steam generator comprises a radiant section in fluid communication with a flue gas stack, the radiant section having an enclosure with a feedwater tube bank disposed therein; a feedwater inlet in fluid communication with the tube bank; and a burner disposed to deliver heat to the enclosure of the radiant section, wherein the wet steam outlet is in fluid communication with the tube bank.

21. The steam supply system of claim 20, wherein the once-through steam generator further comprises a convection section between the radian section and the flue gas stack, wherein the superheater is disposed within the convection section of the once-through steam generator.

22. The system of claim 16, wherein the steam heat exchange conduit is coated with a high temperature superhydrophobic coating.

23. The system of claim 17, further comprising downstream equipment in fluid communication with the process steam outlet of the mixing vessel.

24. The system of claim 23, wherein the downstream equipment is a wellbore tool.

* * * * *